US010124480B2

(12) United States Patent
Ou

(10) Patent No.: US 10,124,480 B2
(45) Date of Patent: Nov. 13, 2018

(54) TOOL BOX

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 178 days.

(21) Appl. No.: 15/156,949

(22) Filed: May 17, 2016

(65) Prior Publication Data

US 2017/0334060 A1 Nov. 23, 2017

(51) Int. Cl.
*B25H 3/02* (2006.01)
*B65D 25/20* (2006.01)

(52) U.S. Cl.
CPC ..... *B25H 3/02* (2013.01); *B65D 25/205* (2013.01)

(58) Field of Classification Search
CPC ..... B25H 3/02; B65D 25/205
USPC ..... 206/372, 373, 459.5
See application file for complete search history.

(56) References Cited

U.S. PATENT DOCUMENTS 6,173,837 B1 * 1/2001 Marconi ..... A45C 3/08 190/125
7,059,472 B2 * 6/2006 Lai ..... B25H 3/02 206/372
7,641,048 B1 * 1/2010 Shih ..... B25H 3/02 206/372
2003/0000863 A1 * 1/2003 Lee ..... B25H 3/02 206/459.5
2004/0112777 A1 * 6/2004 Huang ..... A45C 13/08 206/349

FOREIGN PATENT DOCUMENTS

TW I464045 B 12/2014
TW M496542 U 3/2015

* cited by examiner

*Primary Examiner* — Steven A. Reynolds
(74) *Attorney, Agent, or Firm* — Muncy, Geissler, Olds & Lowe, P.C.

(57) ABSTRACT

A tool box is provided, including a box body and at least one marking member. The box body has two first boards facing each other, two second boards facing each other and at least one recessed portion, each said first board is substantially perpendicular to each said second board, and each said recessed portion is obliquely connected to one said first board and one said second board. The at least one marking member is correspondingly attached to the at least one recessed portion.

3 Claims, 6 Drawing Sheets

TOOL BOX

BACKGROUND OF THE INVENTION

Field of the Invention

The present invention relates to a tool box.

Description of the Prior Art

Usually, the assembly or maintenance staffs need to assemble or disassemble various products, so they need various tools and components in accordance with different requirements. The tools and components are too many to be carried around; therefore, the industry develops a tool box for receiving these tools and components, and the tool box is easy to be carried around and has a preferable loading efficacy. This type of tool box is disclosed in TWM496542 and TWI464045.

However, in this conventional tool box, when a lot of components are placed in different tool boxes or when the tool boxes of different people are placed in the same place, a user may be unable to find his/her tool box immediately, and finding the tool box would be time-consuming.

The present invention has arisen to mitigate and/or obviate the afore-described disadvantages.

SUMMARY OF THE INVENTION

The major object of the present invention is to provide a tool box, which allows a user to know where a tool or a component s/he needs is and to find the tool box s/he needs among a pile of tool boxes immediately.

To achieve the above and other objects, a tool box is provided, including a box body and at least one marking member. The box body has two first boards facing each other, two second boards facing each other and at least one recessed portion, each said first board is substantially perpendicular to each said second board, and each said recessed portion is obliquely connected to one said first board and one said second board. The at least one marking member is correspondingly attached to the at least one recessed portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Please refer to FIGS. 1 to 4 for a preferred embodiment of the present invention. A tool box includes a box body 1 and at least one marking member 7.

Figure 1:
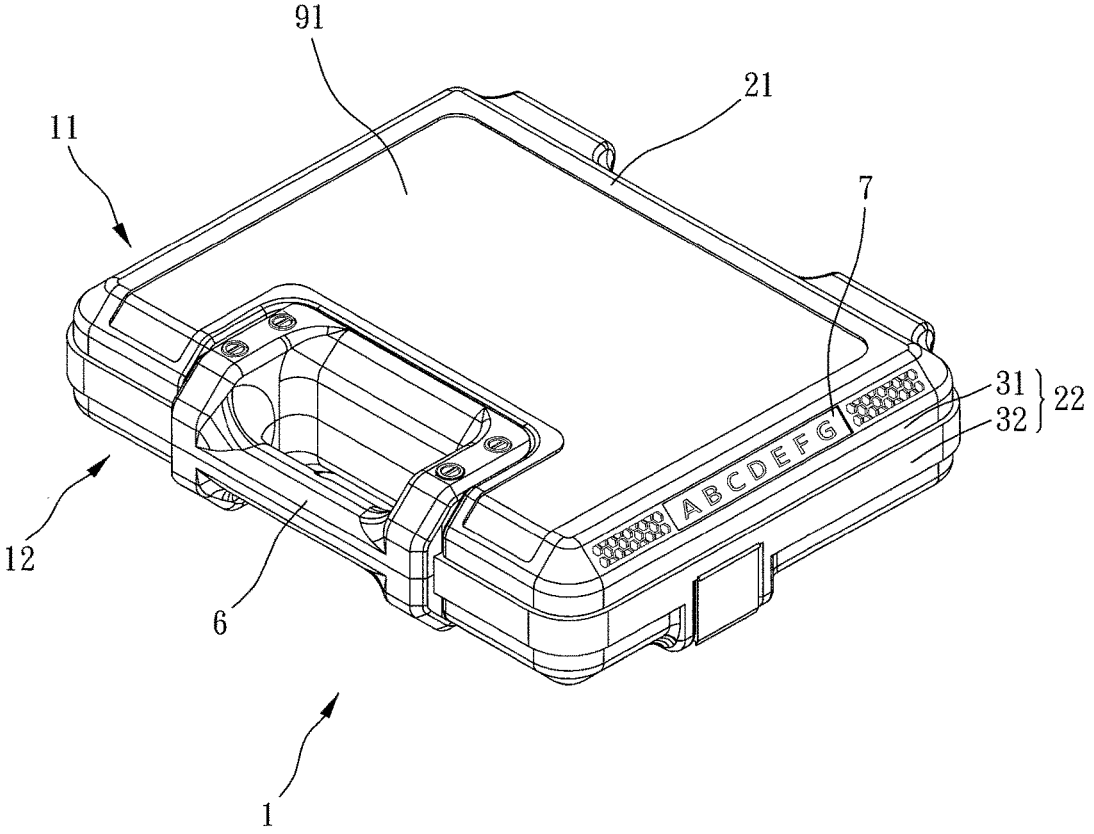
FIG. 1 is a stereogram of a preferred embodiment of the present invention.
Figure 2:
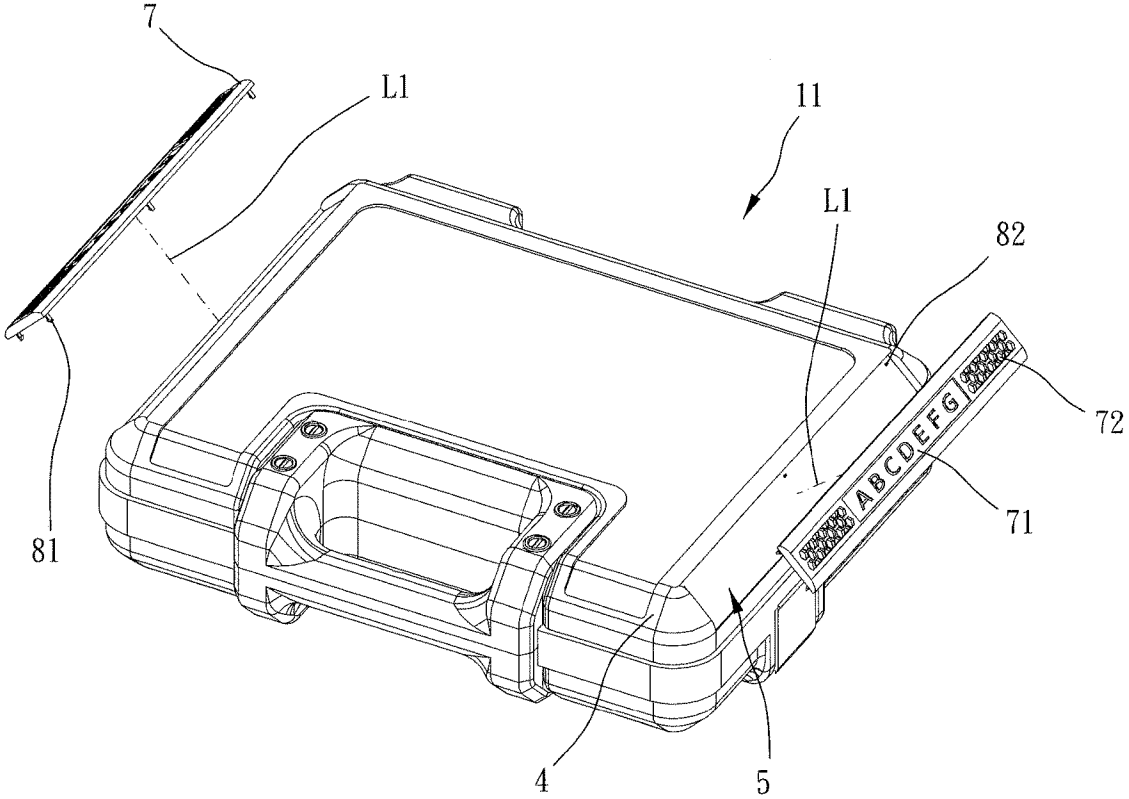
FIG. 2 is a breakdown view of the preferred embodiment of the present invention.
Figure 3:
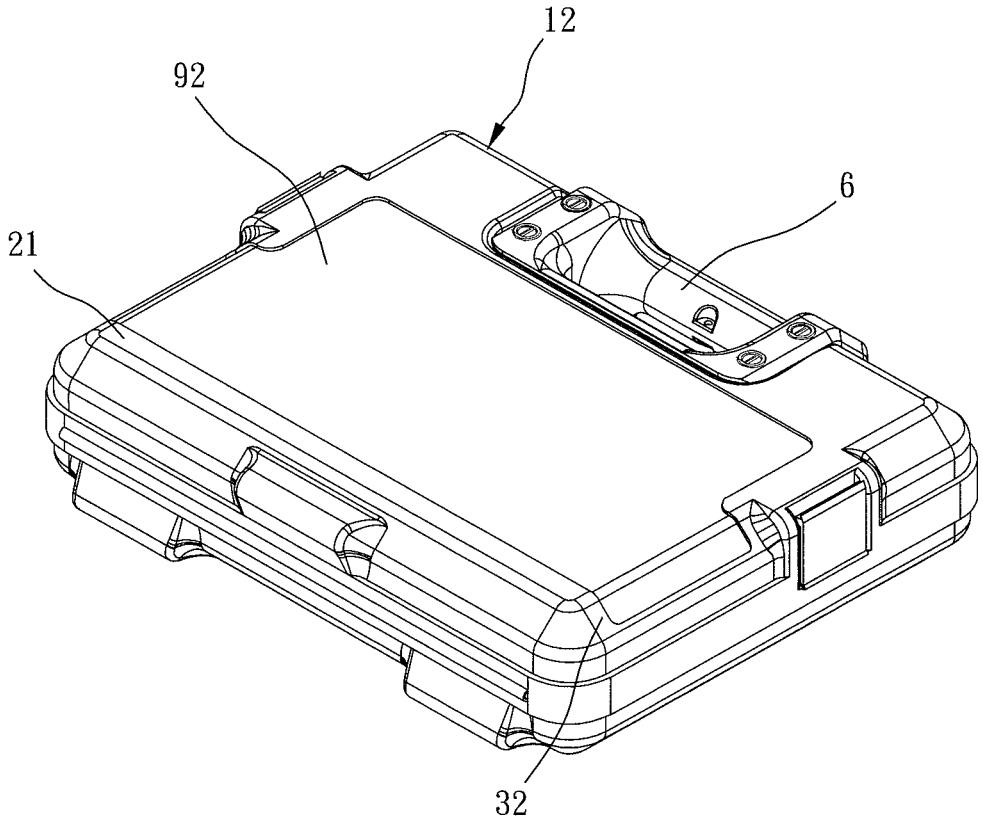
FIG. 3 is a stereogram of the preferred embodiment of the present invention from another perspective.
Figure 4:
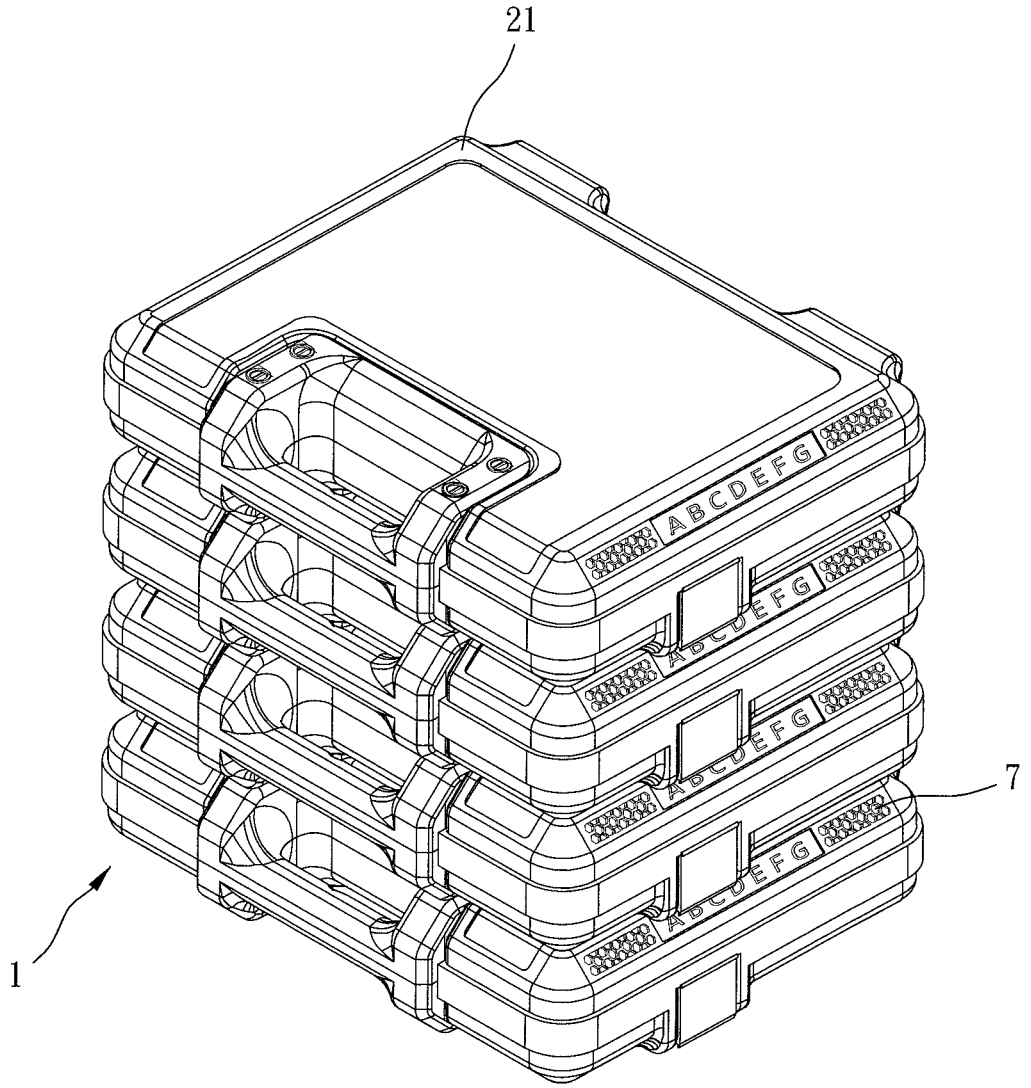
FIG. 4 is a drawing showing the preferred embodiment of the present invention piled up.

The box body 1 has two first boards 21 facing each other, two second boards 22 facing each other and at least one recessed portion 5, each said first board 21 is substantially perpendicular to each said second board 22, and each said recessed portion 5 is obliquely connected to one said first board 21 and one said second board 22. The at least one marking member 7 is correspondingly attached to the at least one recessed portion 5 along a direction indicated by a lead line L1 shown in FIG. 2. Each said marking member 7 includes at least one of a text area 71 and a pattern area 72 so that through watching each said marking member 7, a user can know, for example (but not limited thereto), the user, objects received in the box body 1, a name of a company or a trademark. Furthermore, each said first board 21 preferably extends on a same plane so that each said first board 21 can provide a more stable supporting effect. As shown in FIG. 4, a plurality of the box bodies 1 can be piled up one upon another stably to reduce a space occupied.

It is to be noted that the recessed portion 5 is inclined toward the first and second boards 21, 22; therefore, when the box bodies 1 are piled up, it is convenient for the user to clearly see each said marking member 7 (as shown in FIG. 4) without moving another said box body 1 upon the box body 1. In addition, an object which is located on each said marking member 7 unexpectedly can slide down automatically and will not cover each said marking member 7. The recessed portion 5 is obliquely arranged so that the recessed portion 5 is located by an inner side of an intersection of phantom extensions of the first and second board 21, 22. When there is a collision, the object will contact the first and second boards 21, 22 first so as to make sure that the marking member 7 will not be hit unexpectedly.

In this embodiment, each said marking member 7 further has a first engaging assembly 81, the recessed portion 5 further has a second engaging assembly 82, the second engaging assembly 82 corresponds to the first engaging assembly 81, and the first and second engaging assemblies 81, 82 are engaged with each other. The first engaging assembly 81 is a plurality of protrusions, and the second engaging assembly 82 is a plurality of through holes. In other words, each said marking member 7 is detachably assembled to each said recessed portion 5; therefore, when the tool box is damaged, the user only needs to replace the damaged part.

Figure 5:
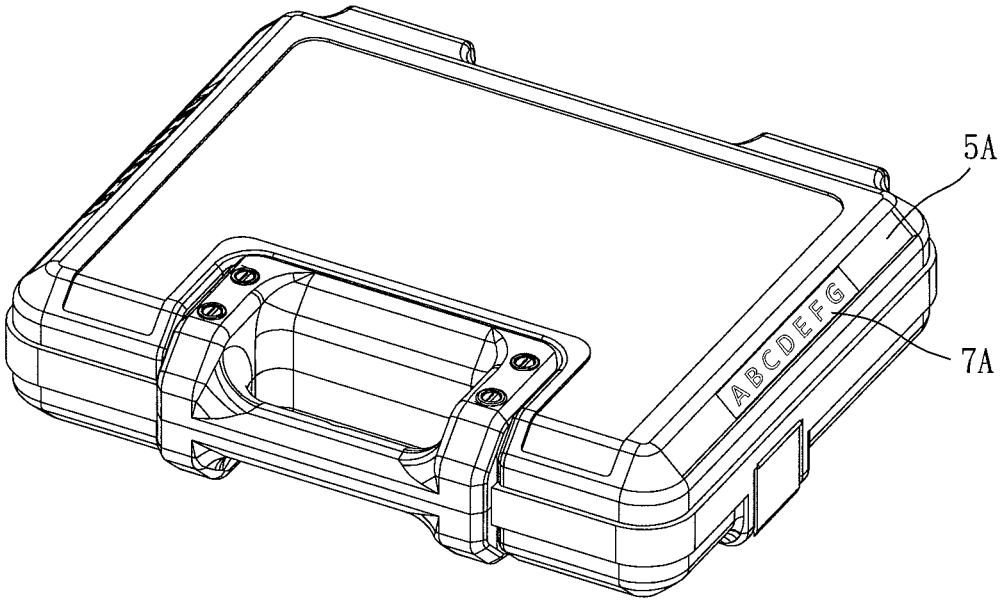
FIG. 5 is a stereogram of another preferred embodiment of the present invention.
Figure 6:
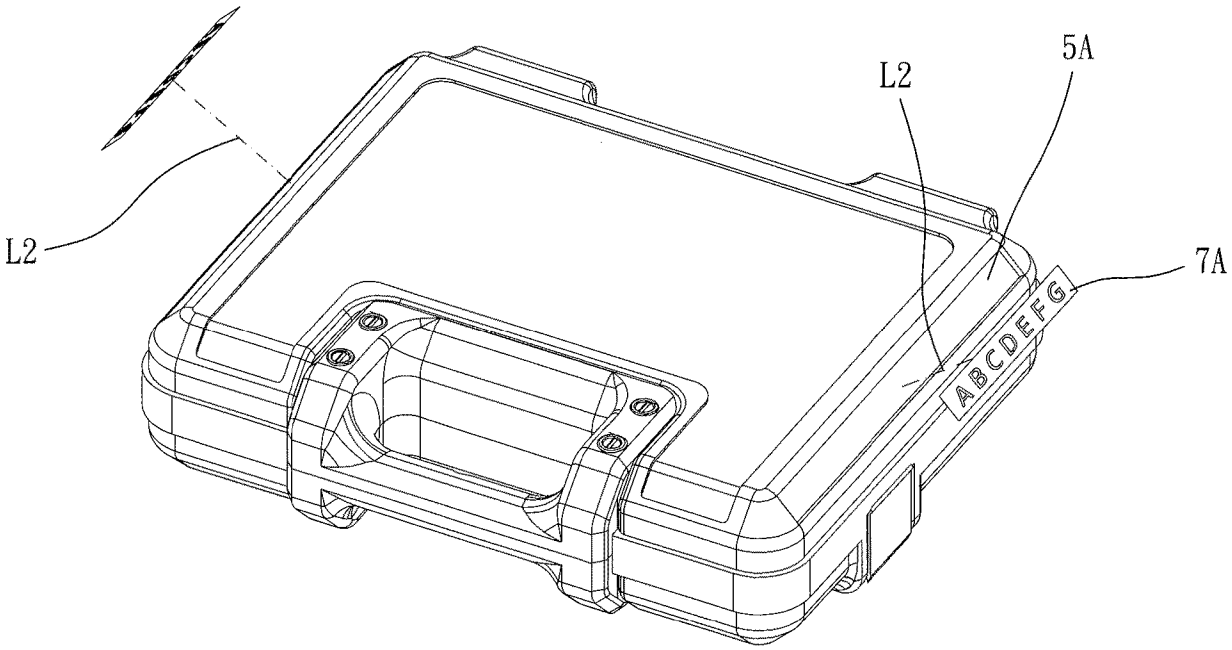
FIG. 6 is a breakdown view of another preferred embodiment of the present invention.

Each said marking member 7 may be assembled in other ways other than the ways mentioned above. As shown in another preferred embodiment of FIGS. 5 and 6, the marking member 7A is stuck on the recessed portion 5A along a direction indicated by a lead line L2 shown in FIG. 6 so that it is quick and cost-saving to manufacture and replace the marking member 7A.

Please refer to FIGS. 1 to 4 for this embodiment, the box body 1 further has a first shell body 11 and a second shell body 12 pivoted to each other. Specifically, the first shell body 11 has one of the first boards 21 and two first sides 31, the second shell body 12 has the other one of the first boards 21 and two second sides 32, and one said first side 31 and one said second side 32 form one said second board 22. In this embodiment, the first shell body 11 has two said recessed portions 5, and each said recessed portion 5 is obliquely connected to the first board 21 and one said first side 31 so that it is convenient for the user to see the marking member 7 from an opposite direction. In addition, when the box body 1 is placed on a lower position or piled up, the second shell body 12 can be placed downwardly so that the first shell body 11 is above the second shell body 12, and the user can see the marking member 7 without moving the box body 1; on the contrary, if the tool box 1 is placed on a higher position, the first shell body 1 can be placed downwardly. It is understandable, the second shell body 12 has the recessed portion 5 for receiving the marking member 7 according to different requirements.

More specifically, the first shell body 11 further has two connecting portions 4 and a first coating 91, each said connecting portion 4 is connected to the first board 21 and the recessed portion 5, the first coating 91 covers at least a part of one of the first boards 21 and extends to cover a part of the two connecting portions 4, the first coating 91 may have different colors (for example, red for wrenches) or patterns (company names or trademarks) according to different requirements, and the first coating 91 may cooperate with the marking member 7 to produce more combinations for categorization. In addition, the box body 1 further has a grip portion 6, the two connecting portions 4 are respectively located on two sides of the grip portion 6, and each said connecting portion 4 is connected to one of the first boards 21 and oblique toward the other one of the first boards 21 so that each said connecting portion 4 may also have advantages as the recessed portion 5. The second shell body 12 further has a second coating 92, the second coating 92 covers at least a part of the other one of the first boards 21 and extends to cover a part of the two second sides 32, and the second coating 92 may be added with more elements or have broader area for identification. Furthermore, the first coating 91 is recessed on the first shell body 11, and the second coating 92 is recessed on the second shell body 12. If a connection between the two first boards 21 is defined as a first direction, as viewed along the first direction, the first coating 91 is substantially U-shaped, and the second coating 92 is substantially reversed T-shaped. Preferably, at least one of a material and a color of each said marking member 7 is different from a material and a color of the box body 1. It is easy for the user to distinguish the tool boxes through the colors of the marking member 7. In this embodiment, the first and second coatings 91, 92 have a same first color, the two first boards 21, the two second boards 22 and the two connecting portions 4 have a same second color, each said marking member has a third color, and the first, second and third colors are different from one another. As for a material of the tool box, the material may be decided according to a durability and usage status of a component. Take this embodiment for example, it is easy for the box body 1 to collide or abrade with other objects, so the box body 1 is designed to be made of a plastic for preferable deformation extent and abrasion resistance; and it is not easy for each said marking member 7 to be hit, so each said marking member 7 is made of a metal for attractive appeal and longer service life. When the box body 1 is damaged, each said marking member 7 can be assembled to another box body 1 which is new.

Given the above, through a position and oblique arrangement of the recessed portion, the user can find the tool box or the objects received in the tool box through watching the marking member. In addition, the marking member is detachably assembled to the box body, and when the marking member is damaged, the user only needs to replace the damaged part without replacing the whole tool box.

While we have shown and described various embodiments in accordance with the present invention, it should be clear to those skilled in the art that further embodiments may be made without departing from the scope of the present invention.

What is claimed is:

1. A tool box, including:

a box body, having two first boards facing each other, two second boards facing each other and at least one recessed portion, each said first board being substantially perpendicular to each said second board, each said recessed portion being obliquely connected to one said first board and one said second board;

at least one marking member, correspondingly attached to the at least one recessed portion;

wherein each said marking member further has a first engaging assembly, the recessed portion further has a second engaging assembly, the second engaging assembly corresponds to the first engaging assembly, and the first and second engaging assemblies are engaged with each other;

wherein the box body further has a first shell body and a second shell body pivoted to each other, the first shell body has one of the first boards and two first sides, the second shell body has the other one of the first boards and two second sides, and one said first side and one said second side form one said second board;

wherein the first shell body has two said recessed portions, and each said recessed portion is obliquely connected to the first board and one said first side;

wherein the first shell body further has two connecting portions and a first coating, each said connecting portion is connected to the first board and the recessed portion, and the first coating covers at least a part of one of the first boards and extends to cover a part of the two connecting portions;

wherein the second shell body further has a second coating, and the second coating covers at least a part of the other one of the first boards and extends to cover a part of the two second sides;

wherein each said first board extends substantially on a same plane, the first engaging assembly is a plurality of protrusions, and the second engaging assembly is a plurality of through holes; the box body further has a grip portion, the two connecting portions are respectively located on two sides of the grip potion, and each said connecting portion is connected to one of the first boards and oblique toward the other one of the first boards; a connection between the two first boards is defined as a first direction, as viewed along the first direction, the first coating is substantially U-shaped, and the second coating is substantially reversed T-shaped; the first coating is recessed on the first shell body, and the second coating is recessed on the second shell body; the first and second coatings have a same first color, the two first boards, the two second boards and the two connecting portions have a same second color, each marking member has a third color, and the first, second and third colors are different from one another; the box body is made of a plastic, and each said marking member is made of a metal.

2. The tool box of claim 1, wherein at least one of a material and a color of each said marking member is different from a material and a color of the box body.

3. The tool box of claim 1, wherein each said marking member includes at least one of a text area and a pattern area.

* * * * *